US006240885B1

(12) United States Patent
Hanson

(10) Patent No.: US 6,240,885 B1
(45) Date of Patent: Jun. 5, 2001

(54) INBOARD FOUR CYCLE GASOLINE MARINE ENGINE FOR SMALL WATER CRAFT

(76) Inventor: Bruce F. Hanson, 633 Collins Rd., Belgrade, MT (US) 59714

( * ) Notice: Subject to any disclaimer, the term of this patent is extended or adjusted under 35 U.S.C. 154(b) by 0 days.

(21) Appl. No.: 09/277,350

(22) Filed: Mar. 26, 1999

Related U.S. Application Data

(60) Provisional application No. 60/079,654, filed on Mar. 27, 1998.

(51) Int. Cl.[7] ..... F02B 75/24
(52) U.S. Cl. ..... 123/55.5; 123/55.2
(58) Field of Search ..... 123/55.2, 55.3, 123/55.4, 55.5

(56) References Cited

U.S. PATENT DOCUMENTS

| | | | | |
|---|---|---|---|---|
| 3,073,291 | * | 1/1963 | Leonard et al. | 123/55.4 |
| 4,026,377 | * | 5/1977 | Jones | 123/55.4 |
| 4,708,107 | * | 11/1987 | Stinebaugh et al. | 123/55.4 |
| 4,836,123 | * | 6/1989 | Grinde et al. | 440/3 |
| 4,981,120 | * | 1/1991 | Mangum, Jr. | 123/149 D |
| 5,579,727 | * | 12/1996 | Logan et al. | 123/41.15 |
| 5,934,229 | * | 8/1999 | Li et al. | 123/55.5 |

* cited by examiner

*Primary Examiner*—Marguerite McMahon
*Assistant Examiner*—Jason Benton
(74) *Attorney, Agent, or Firm*—Jerry Johnson

(57) ABSTRACT

An inboard gasoline marine engine for small water craft comprises a two cylinder horizontally opposed four stroke engine. The engine includes a massive crank shaft rotationally mounted in the crank case of the engine. A small flywheel is connected to one end of the crank shaft. The flywheel additionally drives the propulsion system used along with the engine. The fly wheel is typically disposed at the back of the engine, although positioning the flywheel in the front position would also be possible. Opposite the flywheel on the front of the engine is a main belt for operation of an alternator, and a cover for a timing belt or chain. Two cam shafts are driven by the crank shaft through the timing belt or chain. A cylinder block or jug is located on each end of the crank case. A large bore cylinder (4¼ in.) is disposed in each cylinder jug. Reciprocating in each cylinder is a large diameter piston that has a long stroke (5 in.). Each piston is connected to the crank shaft through a long connecting rod (10 in.). A cylinder head and valve cover are mounted at each end of the engine. Water jackets, that are designed for a marine engine surround the cylinder blocks. A fuel delivery system is used to provide fuel to each cylinder. Specifically, a carburetor is located adjacent to each cylinder head. The engine is capable of operating at very low RPM's. The engine also produces high torques at low seeds. The engine is of a size that minimizes the space occupied by the engine within the small water craft.

10 Claims, 13 Drawing Sheets

INBOARD FOUR CYCLE GASOLINE MARINE ENGINE FOR SMALL WATER CRAFT

RELATED APPLICATIONS

The present application claims the benefit under Title 35, United States Code, Section 119E of the United States Provisional Patent application Ser. No. 60/079,654, filed Mar. 27, 1998 entitled "Crankshaft and Method for achieving Improved Low RPM Operation of an Internal Combustion Engine Designed for Marine Trolling Applications".

BACKGROUND

Gasoline marine engines used in small water craft are typically of two types. A first type is an inboard mounted engine which drives a propulsion unit which may be an outboard mounted propeller or jet. A second type of gasoline marine engine used in small water craft is an outboard engine that mounts high on the transom of the boat. There are significant problems with both types of marine engines.

Inboard engines comprise all types of engine block configurations including V-Block and straight block or in-line engine blocks. Additionally, a small number of gasoline marine engines have been built using an engine block having horizontally opposed cylinders.

These gasoline marine engines are either designed specifically for marine usage or are of automobile origin and have undergone a significant conversion to make the engines appropriate for marine usage. For an engine to be appropriate for marine usage, the engine must satisfy the particular cooling requirements of mounting an engine within the hull of the boat. Specifically, a cooling system is required that will not use a radiator and fan for transferring the heat within the engine coolant to the atmosphere. Additionally, the cooling provided by air passing through the engine compartment of a car will not be present. Automobiles rely heavily on the radiator and fan and air cooling to keep the engine from overheating. Due to the constraints that are particular to mounting an engine within a hull of a small water craft, neither of these cooling modes are typically used on a boat engine.

Consequently, gasoline marine engines for small water craft must include greater engine cooling capabilities. Greater cooling capabilities are required of the water jackets that are cast into the cylinder blocks and cylinder heads. Additionally, cooling capabilities are also required of the exhaust system. Exhaust jackets are typically placed around the exhaust system manifold and pipes to cools these components with cooling water. Water jackets and exhaust jackets, both of which are specifically designed for the cooling requirements of the marine environment, are required in gasoline marine engines.

Coolant systems for marine use are typically of two types. A first system uses a heat transfer mechanism that uses raw water drawn from the water resource to cool the engine coolant used within the water jackets. Alternatively, raw water may in some cases be drawn from the water resource and then passed through the water jackets, and finally returned to the water resource. In each of these systems, raw water, as opposed to air, is used to cool the coolant fluid is used in the engine.

Because of space limitations marine engines are typically not used with a shiftable transmission. The propulsion system is typically driven directly by the flywheel of the engine.

In common jet propulsion systems, the jet impeller speed in RPM's is the same as the engine speed in RPM's. The impeller speeds that result are typically desirable for higher speed boat usage. Most boat engines are unable to run under 500 revolutions per minute, and therefore are driving the impellers at too high of a speed for low speed boating without the difficult use of the reverse bucket to slow the boat speed. These engines also do not allow for the desired level of speed modulation for the boat.

Propeller propulsion systems typically use a gear reduction system. In these systems, the propeller speed is a constant percentage of the engine RPM, as these systems also do not permit any change of the gearing while the boat is operating. These gear reduction systems seldom allow for low enough propeller speeds for low speed fishing which is commonly called trolling. This is because the systems are typically geared for higher speed use. For this reason, a propeller specifically designed for low speed operation must typically be used if low speed operation is desired. These low speed propellers drastically reduce the top end speed of the boat and are not considered desirable by most boat users.

For these reasons, those boat users that desire to operate their boats at trolling speeds are required to install a small trolling engine on their boats. The trolling engine capable of low speeds only becomes the second engine for the boat. These small trolling engines, which are typically outboard engines mounted on the transom of the boat, allow the user to have a high level of modulation control over the boat speed. The use of two engines on a boat is not without consequence, however. Two marine engines often means a doubling of the undesirable maintenance requirements of the boat. There are, of course, additional costs involved in the acquisition of a second engine for the boat. A second engine mounted on the transom also occupies one of the desirable fishing positions available within the hull of the boat.

The other option for low speed of an existing gasoline marine engine is to fit a trolling plate adjacent the propeller that can be pivoted behind the propeller to slow the propulsion of the boat. The use of these trolling plates is undesirable as little modulation of speed is possible. The operation of the trolling plates is also undesirably inconvenient. It is also likely that the use of a trolling plate generates a high level of underwater noise due to the constant striking of water on the plate. This likely would scare away fish from the vicinity of the boat.

Existing inboard gasoline marine engines, in the lower horse power classes, also lack the necessary torque at low speed to push the boat up on plane if the boat is carrying a heavy load of passengers and gear. For boat users that fish in large rivers and rivers with a strong current, there may be considerable frustration involved in getting the boat to move upstream if the boat cannot generate enough low speed torque. Several fishermen and their gear can add a significant load to a small water craft. It is not uncommon for existing gasoline marine engines for small water craft to be inadequate under these conditions.

Larger horsepower inboard gasoline marine engines have the necessary torque for most applications. However, these larger horsepower engines are quite massive, often weighing 900 pounds or more. Of course, the fuel consumption of these engines is also high. This reduces the operating range of the boat and increases the necessary fuel storage and therefore the weight of the fuel on the boat.

An additional problem associated with existing inboard gasoline marine engines of all horse power classes is the size, particularly the height, of the engine. The decks of small water craft have space for seating and gear storage. Unfortunately, the main inboard engine occupies a significant portion of this space at the rear of the boat in front of the transom. The engine typically includes a cover to separate the engine from the interior of the boat. The height of the cover which extends over the engine is typically too high for comfortable or safe seating. Additionally the engine cover restricts the ability of the number of people that can stand at the back of the boat and fish. This position at the back of the boat is typically the most desirable place from which to fish. Due to the shape of existing marine engines for small water craft, very few marine engines have been successful at minimizing the space requirements of an inboard engine.

Existing outboard marine engines also have had significant problems. Most existing outboard engines are two stroke engines that are know to be responsible for extremely high emissions of unburned hydrocarbons, as well as other atmospheric pollutants. Outboard engines also require higher levels of maintenance than inboard engines of comparable horsepower. Although outboard engines do minimize the deck space which the engine occupies, outboard engines do extend quite high above the transom and are an obstruction to using the back of the boat for fishing. The location of outboard engines also has a tendency to increase the noise level within the boat due to the engine.

For the previously mentioned reasons, there is a need for an inboard gasoline marine engine for small water craft that develops sufficient torque to function adequately at low speeds. There is a need that this engine weighs much less than existing engines which are able to produce a high torque at low speeds. This would provide adequate boat operation in river currents, and adequate operation of the boat if the boat is loaded down with people and gear.

There is a farther need for a single inboard gasoline marine engine for small water craft that will operate at very low speeds without stalling so that the single marine engine can be used for low speed trolling. There is a need that this engine also offers the boat operator a high level of speed modulation. There is a need that this engine also has performance characteristics suitable for higher speed boat use.

There is a need that this inboard gasoline marine engine for small water craft be of a minimal height so as to occupy a minimum of deck space in the boat. It would be advantageous that this marine engine would fit under a platform or seat located in front of the transom, or actually fit beneath the deck. This would ensure that a maximum of deck space is available to be fully used by the boat occupants.

There is a need that this inboard gasoline marine engine for small water craft operates with very low polluting exhaust emissions to ensure that minimal harm to water sources and the atmosphere results from using the boat. There is also a need that this engine operates with minimal noise levels. Finally there is a need that the engine operates in a reliable manner and requires a minimum of maintenance.

SUMMARY

The inboard gasoline marine engine for small water craft of the present invention comprises a two cylinder horizontally opposed four stroke engine. The engine includes a massive crank shaft rotationally mounted in the crank case of the engine. A small flywheel is connected to one end of the crank shaft. The flywheel additionally drives the propulsion system used along with the engine. The fly wheel is typically disposed at the back of the engine, although positioning the fly wheel in the front position would also be possible. Opposite the flywheel on the front of the engine is a main belt for operation of an alternator, and a cover for a timing belt or chain. Two cam shafts are driven by the crank shaft through the timing belt or chain. A cylinder block or jug is located on each end of the crank case. A large bore cylinder (4¼ in.) is disposed in each cylinder jug. Reciprocating in each cylinder is a large diameter piston that has a long stroke (5 in.). Each piston is connected to the crank shaft through a long connecting rod (10 in.). A cylinder head and valve cover are mounted at each end of the engine. Water jackets, that are designed for a marine engine that will not use a radiator and fan, surround the cylinder blocks. A fuel delivery system is used to provide fuel to each cylinder. Specifically, a carburetor is located adjacent to each cylinder head. The carburetors that are included in a gasoline fuel delivery system for the engine, could be replaced with fuel injectors. Air induction is also handled by the carburetors that are attached to each cylinder head. In a preferred version, on the top of the engine crank case is a fluid transfer manifold. The fluid transfer manifold distributes engine cooling fluid which has passed through a heat transfer mechanism. The heat transfer mechanism, in a preferred version, uses raw water to lower the temp of the engine cooling fluid. The bottom of the engine is defined by the oil pan An exhaust system comprising a water cooled exhaust pipe extends from each cylinder head. The water cooling for the exhaust pipes is accomplished by water jackets.

The inboard gasoline marine engine for small water craft of the present invention has been designed to solve the size problems that are associated with existing gasoline marine engines. The inboard gasoline marine engine further solves the previously mention problems of inadequate engine torque and insufficient low speed operation that are associated with existing gasoline marine engines for small water craft.

In particular, the inboard gasoline marine engine of the present invention has a length of approximately 41⅜ inches, as measured between the two valve covers, and a height of 17½ inches. This relationship of height to length corresponds perfectly to the mounting location of the engine in front of the transom, and beneath a platform at the back of the boat. Alternatively, the engine mounting location in some cases may actually be beneath the deck. Forward mounting locations, such as those used in competition water skiing water craft, are also possible, with similar benefits.

The height of the engine which of less than half of the length ensures that the engine can be mounted on the hull, while ensuring that adequate air space surrounds the engine. The height of the engine (17½ in.) between the front and rear of the engine is also less than 5 times the bore diameter (4¼ in.) of the cylinder bores. These ratios of engine length to engine height, and bore diameter to engine height have not been used in previously designed inboard gasoline marine engines.

The dimensions of the engine provide many benefits to boat users. Most boats that use an inboard engine have a substantial portion of the boat deck occupied by the engine and the cover which extends over the engine. Typically, only two small seats exist at the back of the boat due to the existence of the marine engine in this location. Current inboard marine engines also are a huge obstruction to the use of the back of the boat for fishing. The present engine allows a fill width seat or an unobstructed fishing platform to be used at the back of the boat. This may allow as many as four passengers to sit at the rear of the boat, or fish from this location. Alternatively, a substantial amount of gear could be stored at this location.

The inboard gasoline marine engine for small water craft of the present invention has been designed to provide high torque to the propulsion system powered by the engine when the engine is operating at low RPM's.

The high torque has been provided by the use of large bore cylinders of approximately 4¼ inches. Additionally, the piston stroke is approximately 5 inches. The large bore and large stroke along with a long connecting rod of 10 inches allow the engine to develop tremendous low-end speed torque. The large bore and large stroke create a large displaced cylinder volume for each of the two pistons used in the engine. The displacement is approximately 70 cubic inches us in each of the cylinders. This displacement per cylinder is higher than what has been previously used in inboard gasoline marine engines for small water craft. This displacement per cylinder is higher than 62.75 cubic inches per cylinder, which is used in a number of current V block automobile engines used for marine use.

The long connecting rod causes the piston to "dwell" longer in the vicinity of top dead center within the cylinder. This is import during the crossover from compression to the power stroke. If the piston dwells near top dead center and ignition is initiated properly, there will actually be a longer period of time for the pressure created during combustion to press against the top of the piston. In effect, increasing the piston dwell allows the pressure to build higher while the minimum cavity exists in the chamber, and this higher pressure level translates into more effort against the head of the piston during the early portion of the power stroke.

There is also a secondary mechanical advantage from a long connecting rod. Since pistons dwell longer near the top of the stroke, the crank arm swings over further before the combustion cavity begins to open. This allows the pressure of combustion to be more effectively transmitted to the crank arm during the period when the pressure is the highest. This increased leverage exists throughout the power phase, though it is most effective in the early portion of the stroke. The end result is a smoother engine that produces more effective work during the power stroke. In simple terms, this translates into more torque and more horsepower.

The high torque at low speeds provided by the inboard gasoline marine engine of the present invention ensures that a boat powered by the present engine will have sufficient torque to operate in river currents or operate when heavily loaded down with passengers and gear.

The inboard gasoline marine engine of the present invention is able to produce the high torque at low speeds only otherwise available by engines weighing as much as three times that of the present invention. The present invention weighs approximately 300 pounds and will produce 150 ft—lbs of torque. Accordingly, the engine has a torque to weight ratio of 1 pound of torque for only 2 pounds of weight.

The inboard gasoline marine engine for small water craft of the present invention has been designed to provide low speed operation to the boat in which the engine is used. Specifically, the engine includes a crank shaft having a large mass and large moment of inertia. The high mass crank of approximately 65 lbs, assists in the low RPM operation of the engine by having a large rotational inertia which is able to produce fill compression of the air and fuel within the cylinders at low RPM's without causing the engine to stall. The high mass crank also assists in the low RPM operation of the engine by mining torsional distortion cause by the opposing cylinders pushing on the crank. The minimizing of torsional distortion further minimizes vibrational shaking which can interfere with low RPM operation of an engine. The crank shaft also includes a close spacing of the journals and counterweights. Two cylinder horizontal opposed engines have had a tendency to rock forward and rearward which can interfere with operation of an engine. The high mass and close spacing of the crank both assist in minimizing the rocking.

The high mass crank, in providing a high rotating moment of inertia to the engine allows for the use of a low mass flywheel. The flywheel weighs only 5 pounds.

Also included in the design of the engine are long but light connecting rods, and light pistons. By minimizing the weight of these components, the engine is further able to minimize rocking and vibration by minimizing the pulling apart of the engine by the rotational mass of the reciprocating pistons and connecting rods.

The cam timing is also set to leave an adequate amount of residual exhaust remaining in the cylinder during the intake stroke to maintain the heat necessary for combustion. This also assists in low RPM operation of the engine as inadequate heat for combustion will cause stalling of an engine.

The low RPM operation of the engine is unique in inboard gasoline marine engines for small water craft. The present invention is able to run reliably with a base idle of substantially lower than 500 RPM. The present invention is able to run reliably at a base idle of 350 to 375 RPM. This contrasts with a base of 500 for the next lowest advertised base idle for existing inboard gasoline marine engines.

The low RPM operation allows for the use of a single engine in a water craft which is capable of significant low speed modulation and is thus suitable for providing desirable trolling speeds for fishing from the water craft. The low hull speeds which are provided by the engine obviate the need for a trolling engine or a trolling plate. The exclusion of a trolling engine further minimizes the space in the boat that is occupied by engines and is therefore unusable for fishing or is other recreational uses. The exclusion of a trolling engine also eliminates weight.

The inboard gasoline marine engine of the present invention runs cleanly and meets all emissions standards. The environmental benefits of the present invention over existing marine engines are significant. The clean, quiet operation of the engine results in minimal environmental impacts from the use of a water craft powered by the engine.

The inboard gasoline marine engine of the present invention is not of automobile origin, but is specifically designed as a marine engine for small water craft.

As has been described in this summary, the present invention is designed to provide the performance required by small water craft such as river boats, work boats, pontoon boats, water skiing boats, fishing boats, and deck boats.

These and other features and advantages of the present invention will be apparent upon inspection of the following drawings, description, and claims.

DRAWINGS

DESCRIPTION

Figure 1:
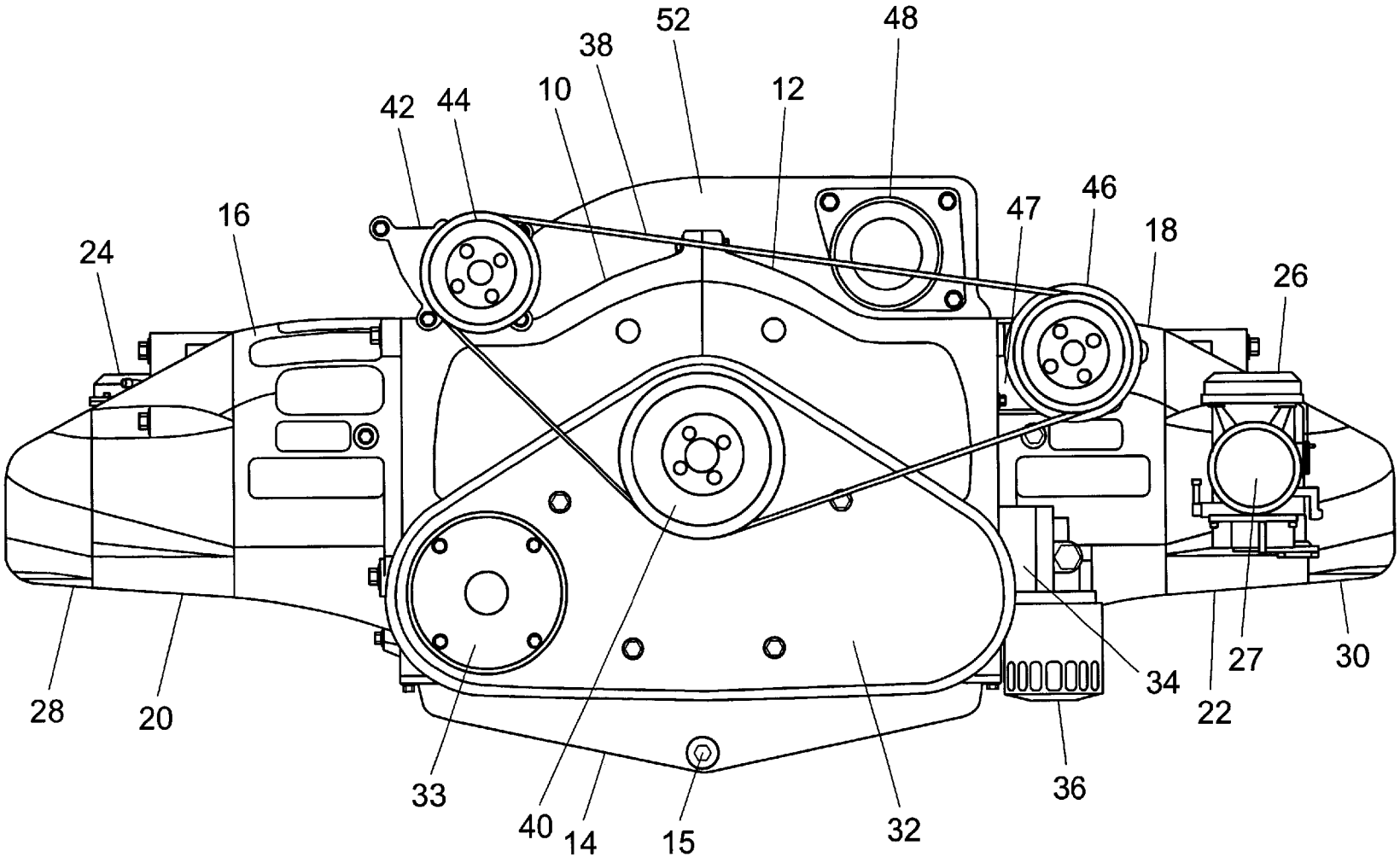
FIG. 1 is a front view of the horizontally opposed four cycle inboard gasoline marine engine for small water craft of the present invention.

FIG. 1 is a front view of the horizontally opposed four cycle inboard gasoline marine engine for small water craft of the present invention. This view shows a crank case comprising first and second crank case halves 10 and 12. The crank case encloses the rotating crank shaft of the engine, as well as the connecting arms that attach pistons to the crank shaft. First and second cam shafts are also disposed in the crank case. These interior engine components will be shown and disclosed in later drawings and are not shown in FIG. 1.

The crank case bottom includes an oil pan 14 and drain plug 15. First and second horizontally disposed cylinder jugs 16 and 18 are secured to the opposite ends of the crank case at 180 degrees from each other. Within each cylinder jug is a cylinder bore and a piston which reciprocates within the cylinder bore. Capping each cylinder bore are first and second cylinder heads 20 and 22. The inside of the cylinder heads define the top of the combustion chambers for both cylinders. The combustion ratio within the cylinders is approximately 9.

An induction port and an exhaust port are included in each cylinder head. A valve (not shown) is disposed within each of these ports. Attached to cylinder heads 20 and 22 are first and second small bore carburetors 24 and 26. Carburetor 26 shows an air inlet 27. Carburetors 24 and 26 produce the proper fuel and air mixtures that are introduced into the combustion chamber of each cylinder through the inlet port. A spark plug (not shown) is also disposed in each cylinder head.

First and second valve covers 28 and 30 enclose the overhead valves of each cylinder. The valve covers include a distal end. The engine includes a length defined by the distance between the distal ends of the two valve covers which is 41⅜ inches.

Also shown in FIG. 1 is a timing belt cover 32 which is attached to the front of the crank case and encloses the timing belt which is driven by the crank shaft and which rotates the two cam shafts at the proper speed. An engine drive belt 38 is shown which is rotated by a pulley wheel 40. The pulley wheel 40 is rotated by the crank shaft. The belt 38 rotates pulley wheel 44 of a water pump 42. The water pump is part if the engine cooling system. The water pump delivers coolant fluid to the water jackets disposed around the cylinder bores. The belt 38 also drives the pulley 46 of the alternator 47. A starter motor 48 is also shown which engages the ring gear of the flywheel. The starter motor 48 is disposed near the bell housing top 50.

Figure 2:
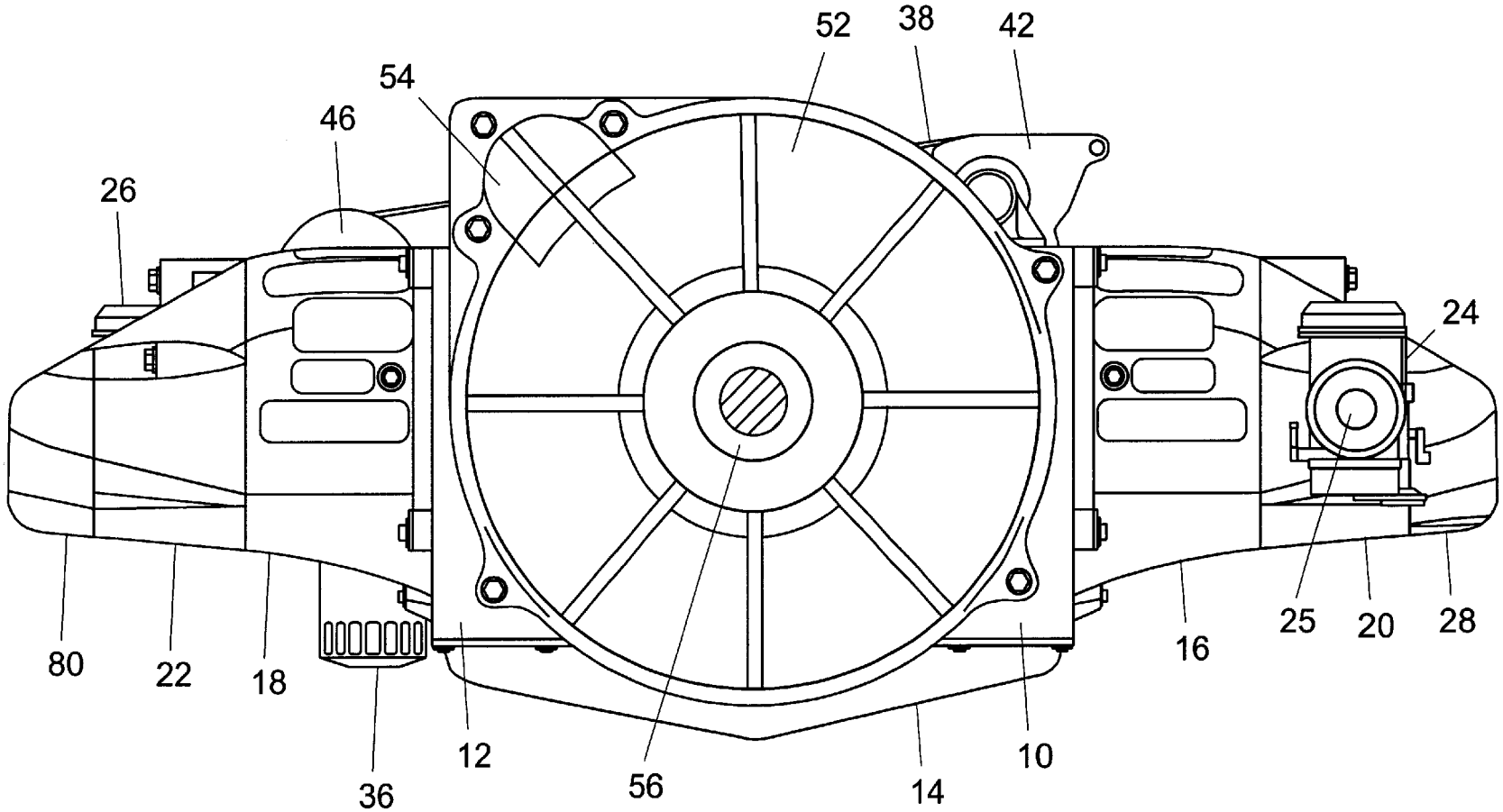
FIG. 2 shows a rear view of the engine.

FIG. 2 shows a rear view of the engine. In this view, the full bell housing 52 is shown, as is the center of the flywheel 56. A starter housing 54 which receives the starter is also shown on the bell housing. FIG. 2 shows the height of the engine which is defined by the distance from the top 50 of the bell housing 52 to the bottom of the oil pan 14. This height is 17¾ inches. The height is considerably smaller than other existing four cycle inboard gasoline engines for small water craft. It would be possible, although difficult, to decrease the height by decreasing the size of the flywheel and the bell housing. Such a modification is within the scope of the invention. Additionally, all engine components such as the starter motor, water pump and associated hoses and manifolds, and the alternator are mounted on the engine in such a manner as to not extend vertically above the top of the bell housing.

Figure 3:
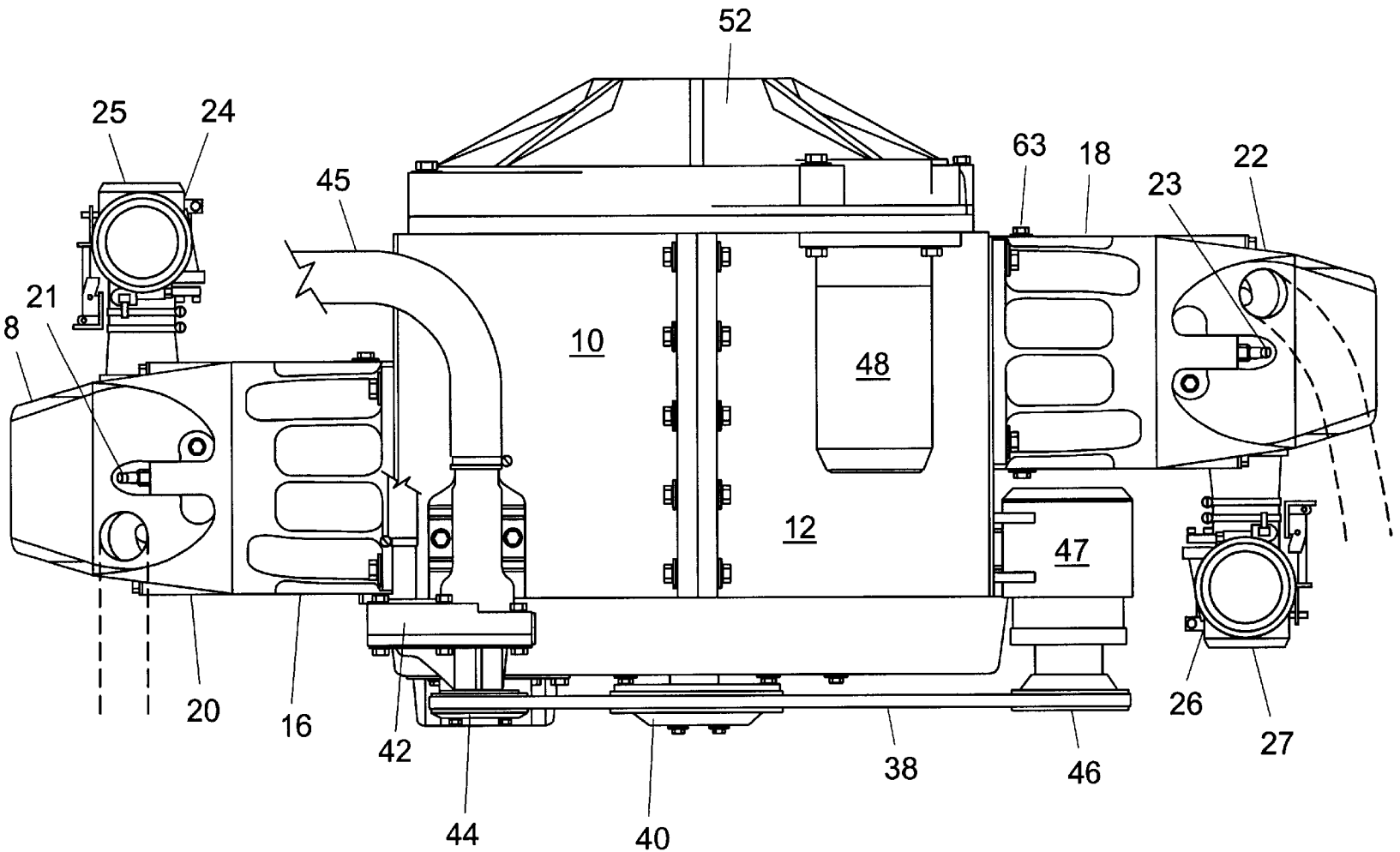
FIG. 3 shows a top view of the engine.

FIG. 3 shows a top view of the engine. In this view, both carburetors are shown, as are the spark plugs 21 and 23 and exhaust ports 29 and 31. FIG. 3 also shows the cold water inlet hose 43 for the cooling system, and the water pump outlet 45 which feeds a coolant fluid to the water jackets of both cylinders through suitable inlets such as is shown at 60 and 61. Suitable hoses, which are not shown in this figure, would be used for this purpose. Water jacket coolant outlets 62 and 63 would be connected by hoses to a heat transfer mechanism that uses raw water for cooling the coolant fluid. In a preferred version, the water pump 42 feeds coolant fluid to a fluid transfer manifold which then feeds a coolant fluid to the water jackets of both cylinders. The cooling system will be shown in greater detail in FIG. 9.

Figure 4:
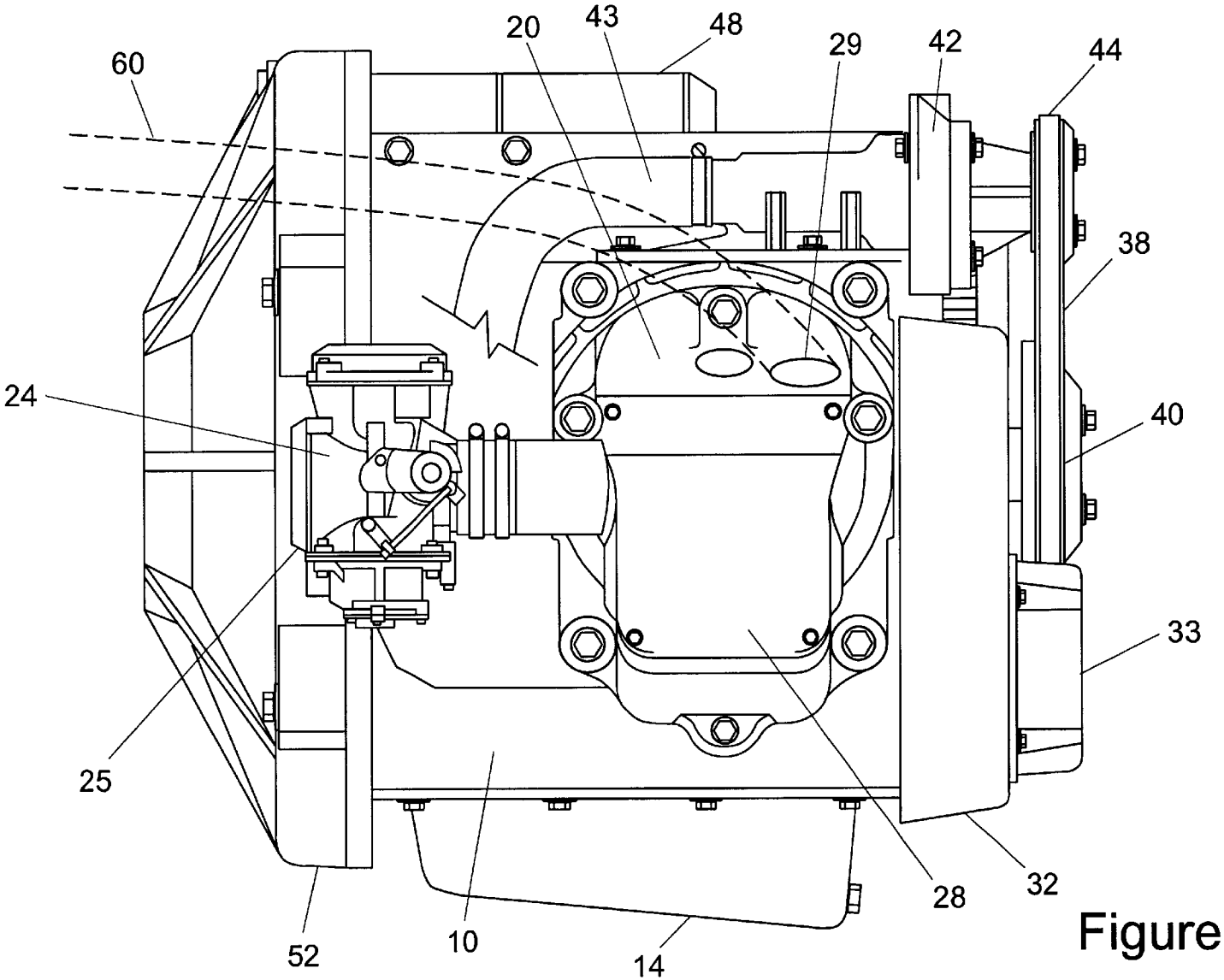
FIG. 4 shows a side view of the engine.

FIG. 4 shows a side view of the engine. This view shows the front to back width of the engine to be only 19½ inches. Also shown is the path of an exhaust pipe 60, which is shown extending from the engine at exhaust port in dashed lines. The exhaust pipe extends upward to form a water trap and the bends downwardly to a position where the exhaust pipe would exit the transom of the boat.

Figure 5:
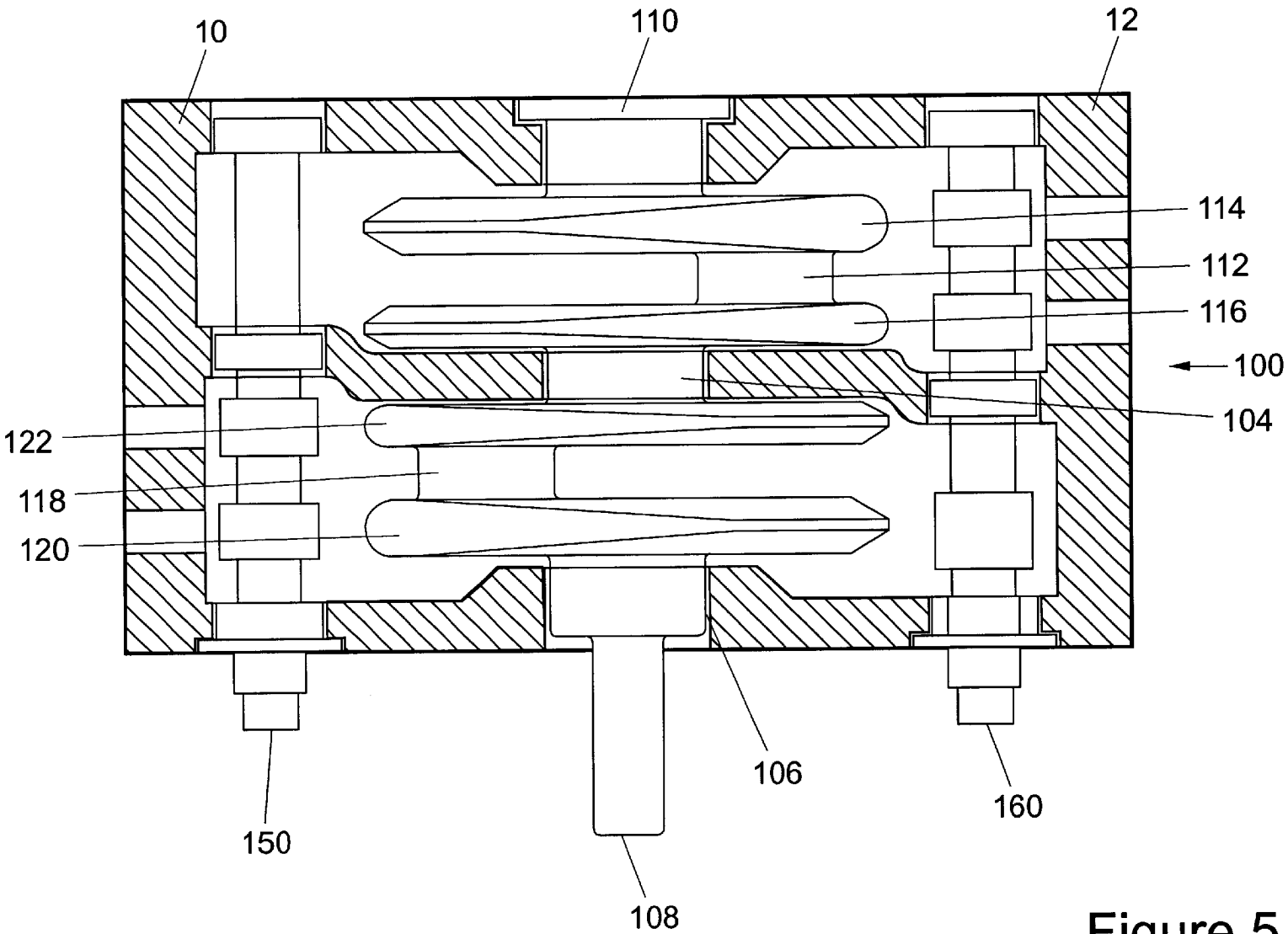
FIG. 5 shows a top view of the engine crank case shown in cross section.

FIG. 5 shows a top view of a portion of the engine with the crank case halves 10 and 12 shown in cross section. This view shows the massive crank shaft used in the engine. The relative position of the first and second cam shafts 150 and 151 to the crank shaft are also shown in this figure.

The crank shaft includes three main bearings 102, 104 and 106, a first end 108, which may be attached to a vibration damper, and a flywheel end 110. A first cylinder journal bearing 112 which is intermediate counterweights 114 and 116, and a second cylinder journal 118 which is intermediate the counterweights 120 and 122 are also shown. The journal offsets or throws from the main bearing axis of the crank shaft are 2½ inches creating a 5 inch stroke for both pistons. The counterweights and journals have been placed as close as possible to decrease the rocking due to the opposing cylinders. If more than two cylinders are used in the engine, which is possible, the rocking, which is characteristic of two cylinder horizontally opposed engines, would be less of a concern.

The crank shaft weighs 65 pounds which results in a rotating mass of 32.5 pounds of mass per cylinder due to the crank shaft alone. The moment of inertia of the crank shaft is approximately 480 pound * inch ^2. This high mass results in a high inertia that ensures that even at very low RPM's, full compression will achieved in the cylinders, and the engine will not stall. The high rotating mass per cylinder is disproportionate to that shown in prior art marine engines, and is primarily responsible for allowing the engine to operate at low RPM's below 400 RPM. The use of a high mass crank shaft, and the use three main bearings supporting the crank shaft, both contribute to minimizing the rocking of the crank shaft caused by the two opposing pistons pushing on the crank shaft This rocking is characteristic of two cylinder horizontally opposed engines. The use of a high mass of the crank shaft, and the use three main bearings supporting the crank shaft, both also contribute to reducing overall vibrations of the engine.

Figure 6:
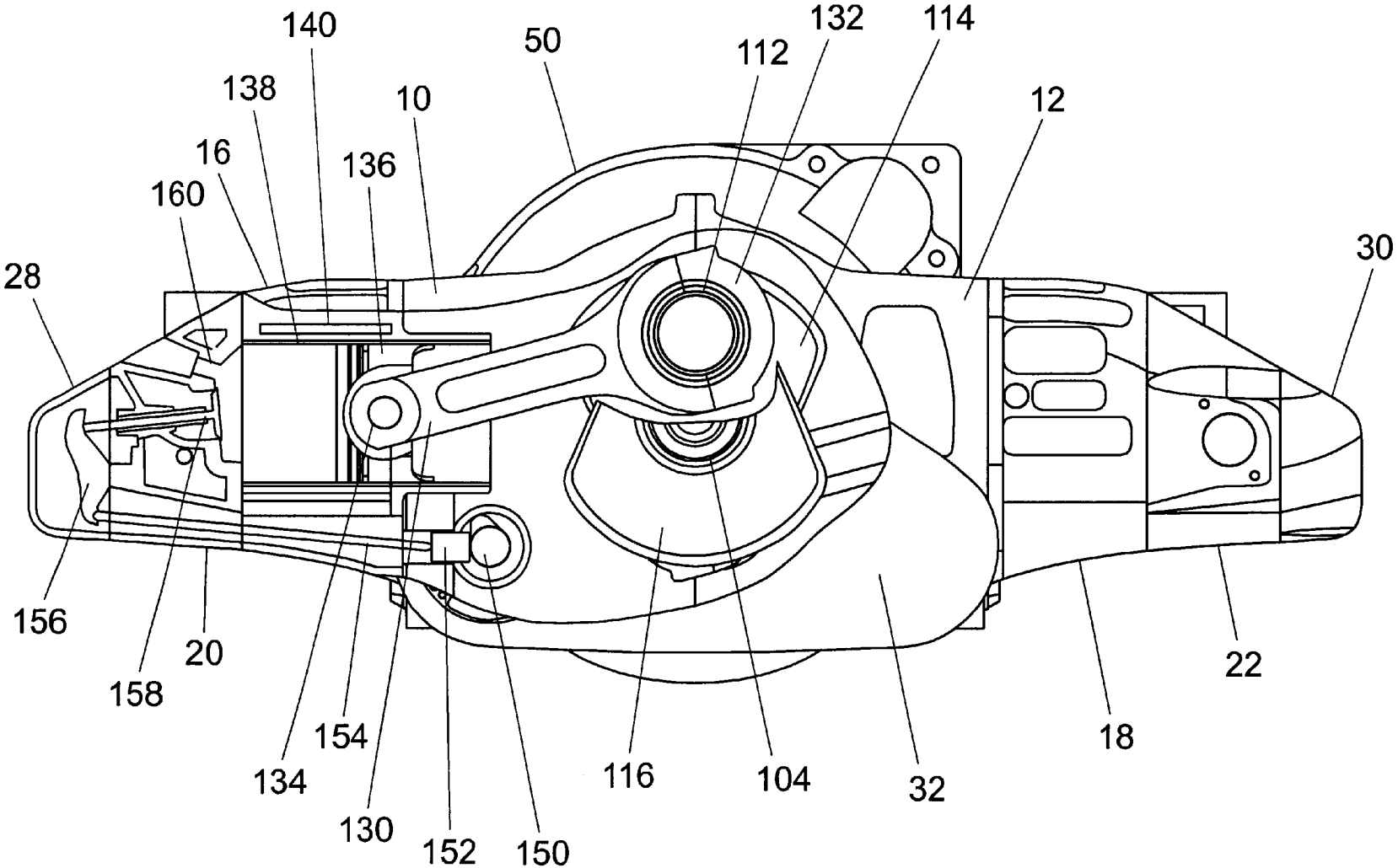
FIG. 6 shows the engine front view of FIG. 1, in a partial cross section.

FIG. 6 shows the engine front view of FIG. 1, with a partial cross section showing the interior of the crank case halves 10 and 12, cylinder jug 16, cylinder head 20 and valve cover 28. In this figure, the long length of the connecting rod 130 can be seen. Specifically, the connecting rod 130 measures 10 inches from the center of the journal bearing 112 to the center of the piston pin 134. Attached to the connecting rod 130 is piston 13 which is disposed within the cylinder bore which measures 4¼ inches. Surrounding the cylinder bore 138 is a water jacket 140 which provides cooling fluid to cool the cylinder. The cam shaft 150 is shown with the lobe shown having rotated past the valve lifter 152. Valve lifter 152 is attached to a push rod which engages rocker arm 156, and thus actuates exhaust valve 158. Spark plug location 160 is shown above the valve 158.

FIG. 6 shows that the overall engine height, in relation to the throws of the crank shaft, is remarkably short. The overall height is less than twice the length of the connecting rods. The overall height is less than 5 times the bore. This compactness provides considerable benefits to the placement of the engine within the size constraints of a small water craft. The low overall height of the engine in relation to the large bores and large crank shaft throws is disproportionate to that shown in prior art marine engines.

The large bore and stroke of the engine are also disproportionate to that shown in prior art marine engines. The large bore and stroke result in a the engine producing high torques at low RPM's. The displaced volume per cylinder of the engine is at least 68 cubic inches. In marine engines, such a large displacement per cylinder is only available in large V block automobile engines which are converted for marine use. Such large V block engines, which do provide high torques at low speeds, do not have the size benefits of the present invention, nor are such engines capable of the low speed operation provided by the present invention.

Figure 7:
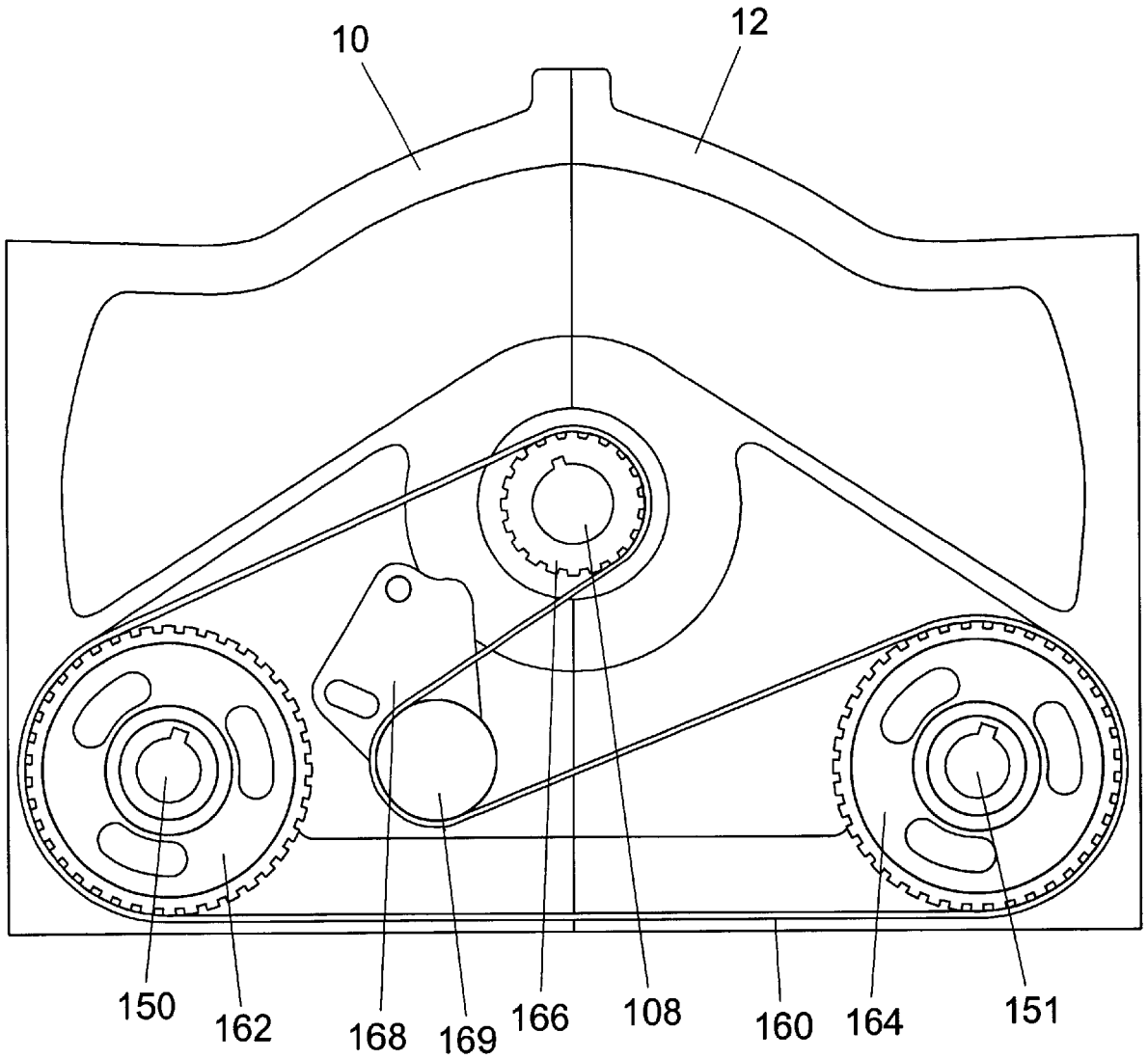
FIG. 7 is a front view of the crank case with the timing belt cover removed.

FIG. 7 is a front view of the crank case with the timing belt cover removed. FIG. 7 shows the crank shaft end 108 which rotates the timing belt 160 through gear 166. The timing belt 160 rotates the cam shaft gears 162 and 164 which both have twice the diameter of the gear 166. The timing belt causes the short duration cam shafts 150 and 151 to rotate at half the speed of the crank shaft 108. Also included in this figure is a belt tensioning bracket 168 which includes tension wheel 169.

The cam timing is set to leave an adequate amount of residual exhaust remaining in the cylinder during the intake stroke to maintain the heat necessary for combustion. This also assists in low RPM operation of the engine as inadequate heat for combustion will cause stalling of an engine. The overlap period when the exhaust valve and intake valve are open simultaneously is approximately 30 to 35 degrees. The operable overlap period is between 10 and 40 degrees.

The low RPM operation of the engine is unique in inboard gasoline marine engines for small water crap. The present invention is able to run reliably with a base idle of substantially lower than 500 RPM. The present invention is able to run reliably at a base idle of less than 400 RPM, typically 350 to 375 RPM. This contrasts with the next lowest advertised base idle for existing inboard gasoline marine engines, which is 500 RPM.

Through the use of the large mass crank and the proper cam timing, the present invention teaches a new method of operating an engine for a small water craft at a low RPM. This method obviates the need for a second small trolling motor, which is currently required for low speed operation. Also contributing to the low RPM operation of the engine are engine components that increase the air speed during induction to ensure sufficient filling of the combustion chamber. These components include the large cylinder capacity (the larger the cylinder the greater the void which is need to be filled by the atmosphere when the valve opens, this raises air speed which aids in filling the cylinder at low RPM's), long connecting rods (the piston dwells longer at top dead center with a long rod, consequently, cylinder gas expansion pressures are increased), a short duration camshaft (the short periods of time that the valve is open result in greater air speeds as the atmospheric air tries to fill the void caused by the descending piston on the intake stroke), a small bore carburetor (the smaller the throttle bore, the more restrictive the throttling which causes increased atmospheric air speed which aids in cylinder filling at low RPM), a short intake pipe (a short pipe causes less elastic stretch of the air column, and results in a stronger pull on the throttle valve at intake opening), and unrestrictive intake and exhaust runners (high efficiency of the intake and exhaust system aids in cylinder filling at low RPM). Also assisting in the low RPM operation of the engine are delayed exhaust valve opening to extend the timing of the power phase to maize low speed torque, early intake valve closing (this increases low speed torque and reduces low RPM reverse pulsing), Additionally, the use of two cylinders in the engine contributes to low speed operation because of fewer power cycles occur per revolution of the crank shaft.

The present engine provides the benefits of low speed operation, but also allows high speed operation of the water craft. This is because low speeds can be attained through the low RPM operation of the boat, as opposed to the use of special low speed propellers.

Figure 8A:
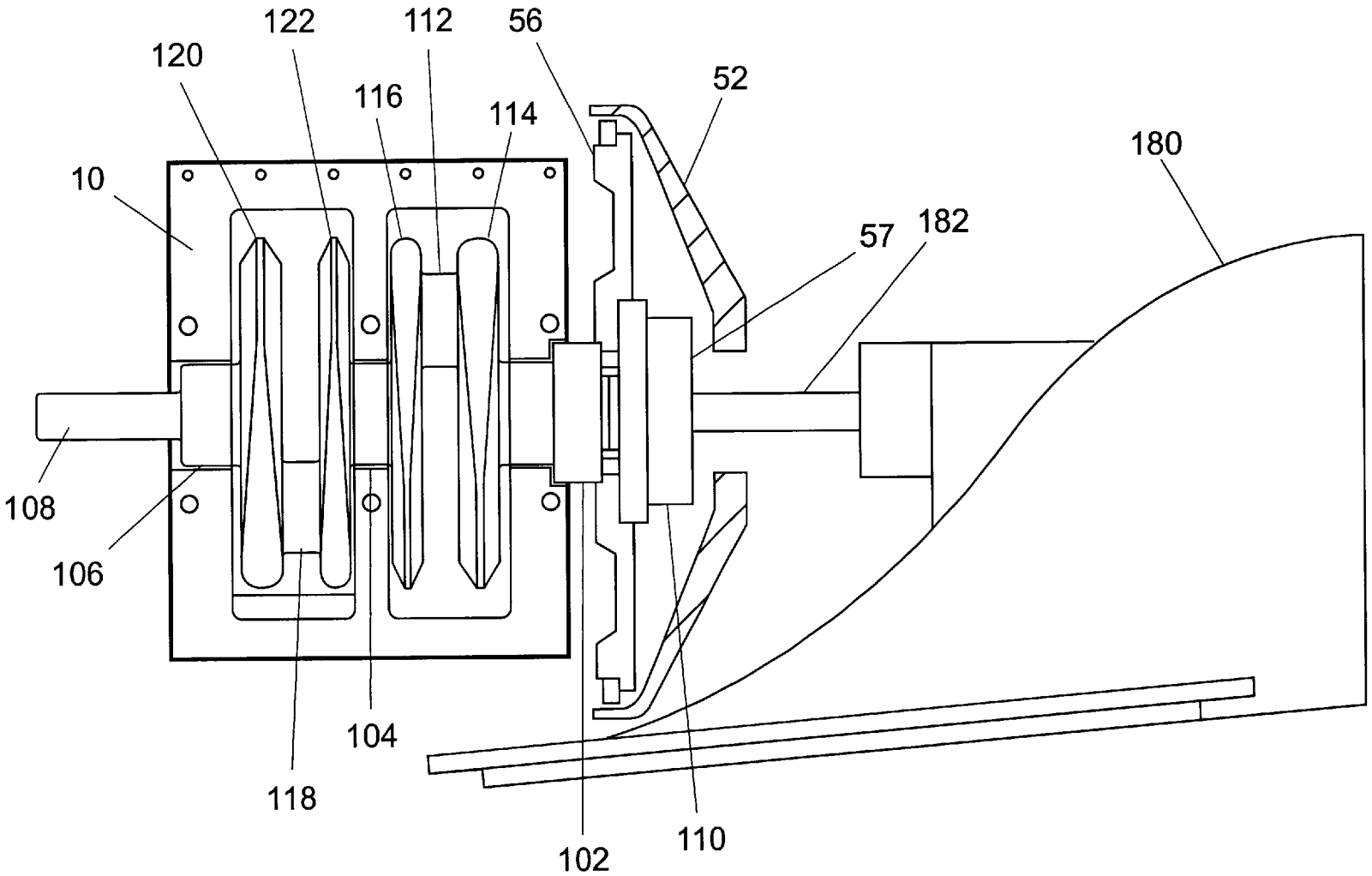
FIG. 8A shows the interior of the crank case.

FIG. 8A shows the interior of the crank case half 10 after removal of the other crank case half 12. This figure shows the light weight flywheel 56 which is attached to the flywheel end 110 of the crank shaft. The flywheel weighs only approximately 5 pounds, and has a low moment of inertia of approximately 75 pound * inch ^2. A suitable coupling plate 57 attaches drive shaft 182 of a commercially available jet propulsion unit 180 to the flywheel. The flywheel is used in the engine both as means for attachment of a marine propulsion system and as a support for the ring gear used by the starter which is not clearly shown in this figure.

Figure 8B:
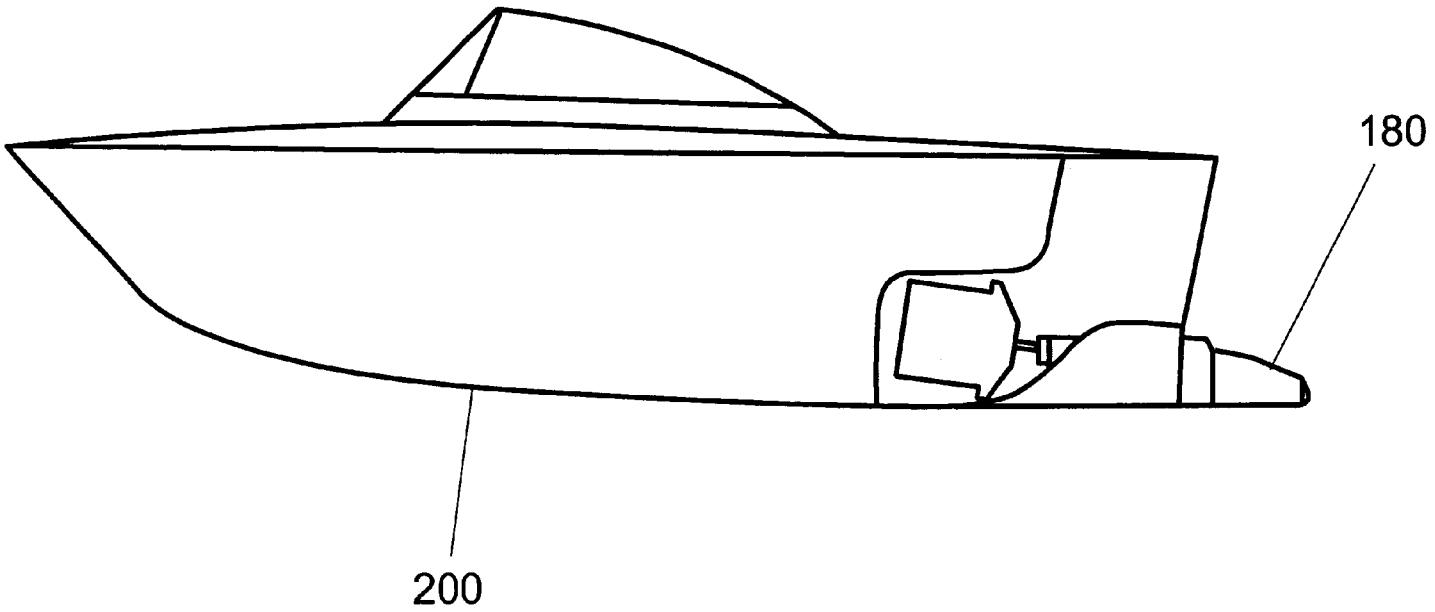
FIG. 8B shows the inclusion of the marine engine of the present invention and a commercially available jet propulsion system into a small water craft.

FIG. 8B shows the inclusion of the marine engine of the present invention and a commercially available jet propulsion system 180 into the small water craft 200. In this figure, the low height of the engine as it is installed within the hull of the small water craft is shown. The platform 210 above the engine may be a seat, or a standing platform for fishing. Should the hull be deep enough, the platform may be the actual deck.

Figure 8C:
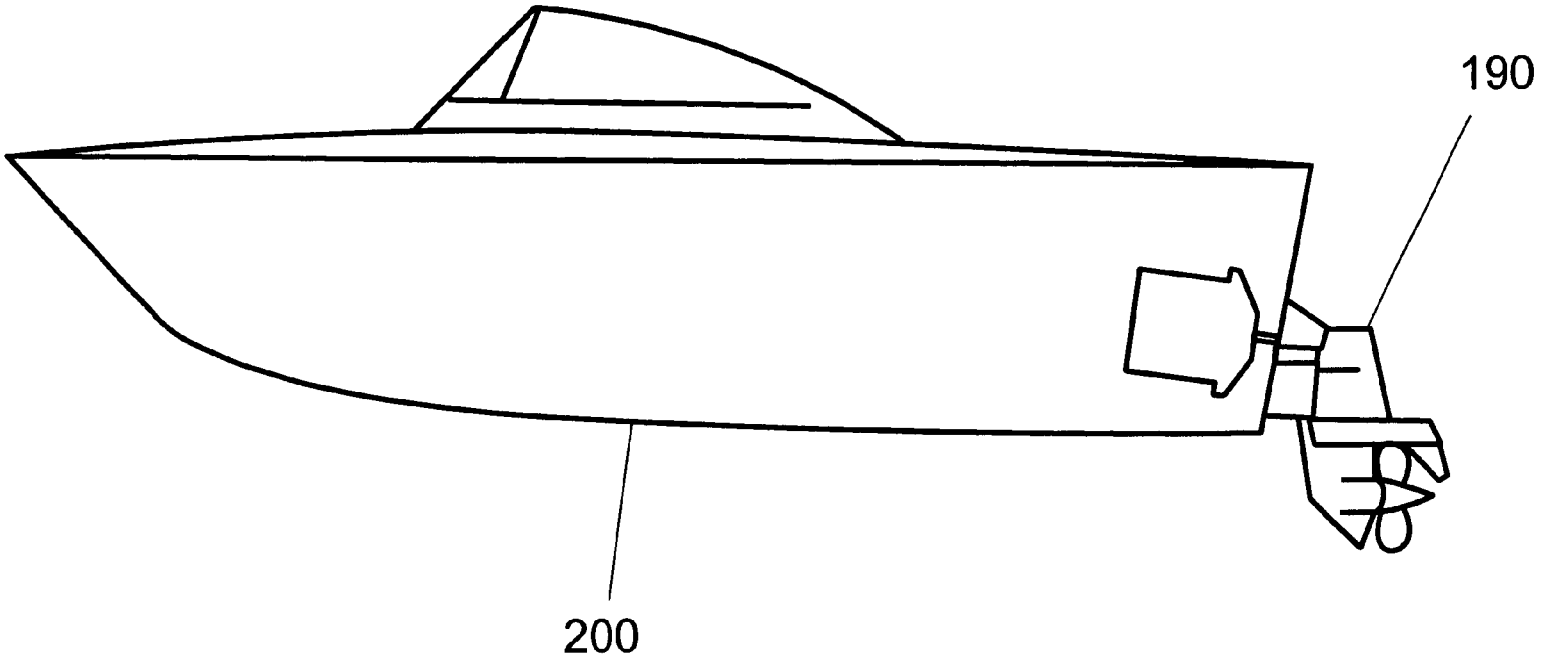
FIG. 8C shows the inclusion of the marine engine of the present invention and a commercially available propeller propulsion system into a small water craft.

FIG. 8C shows a commercially available propeller propulsion I/O system powered by the engine of the present invention. As was mentioned earlier, a low speed propeller would not have to be used in the propeller propulsion system, as low speeds are provided by the low RPM operation of the engine. It is possible to achieve trolling speeds of less than 2 miles per hour while operating the engine at low RPM's which powers a propeller system fitted with a midrange or high speed propeller. Here again, the engine is positioned low in the hull and occupies a minimum of space within the small water craft.

Figure 8D:
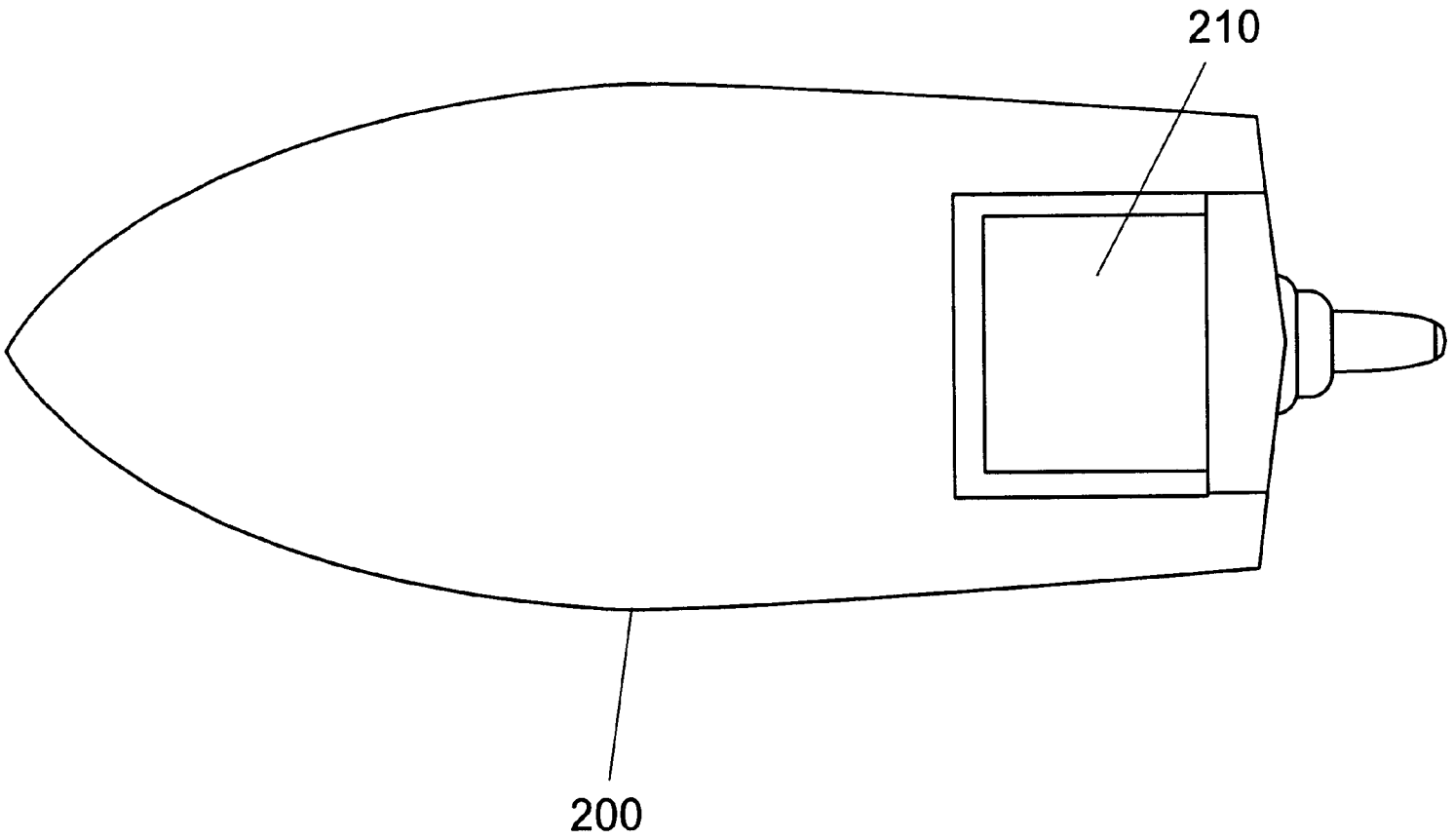
FIG. 8D shows the a top view into the hull of the small water craft.

FIG. 8D shows the a top view into the hull of the small water craft 200 showing the position of the platform 210.

Figure 9:
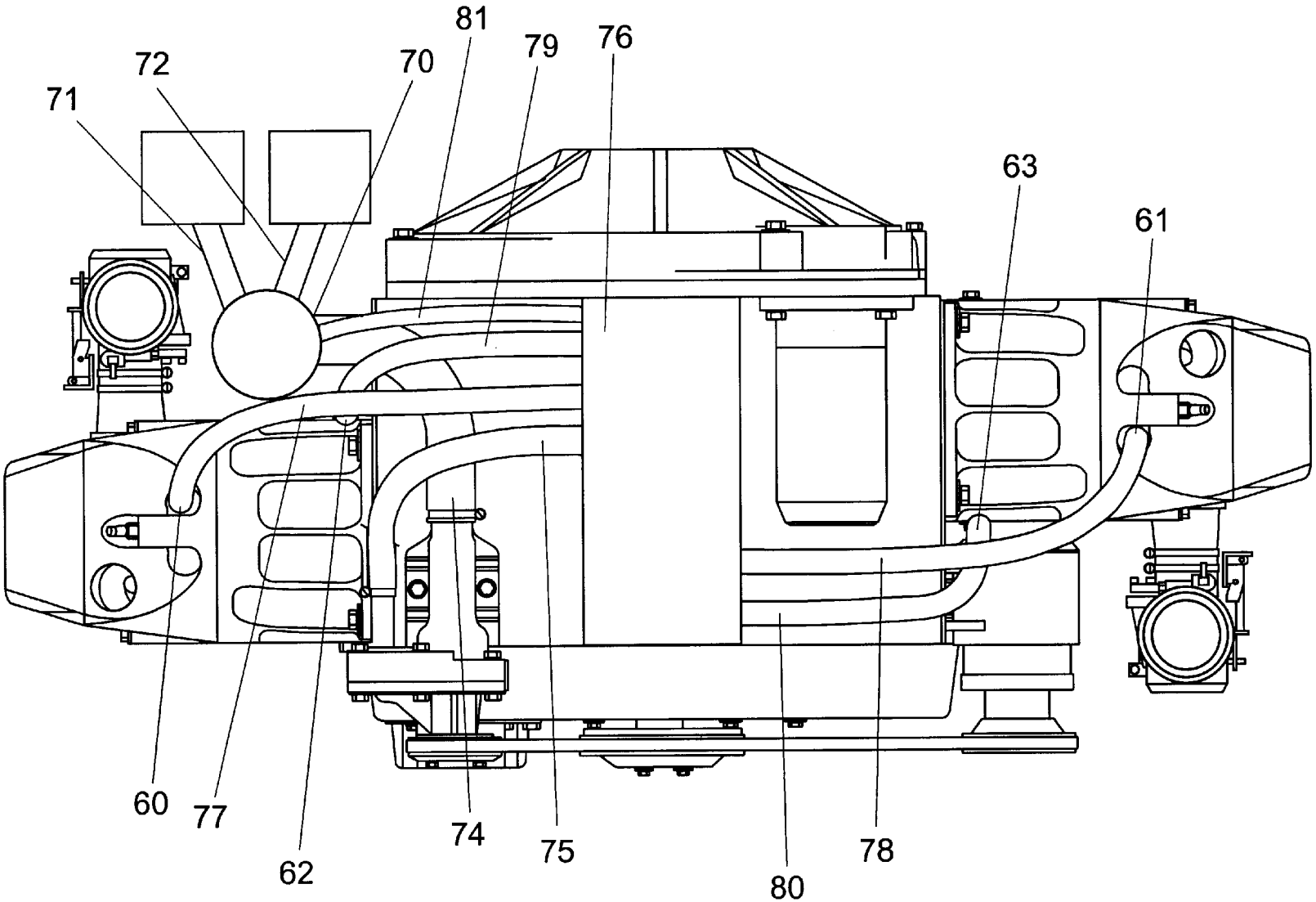
FIG. 9 is a top view of the engine showing a preferred version of the cooling system which is used with the engine of the present invention.

FIG. 9 is a top view showing a preferred version of the cooling system which is used with the engine of the present invention. The cooling system includes a heat transfer cylinder which includes an inlet hose 71 which connects the heat transfer cylinder to a raw water inlet and pump. The raw water inlet and pump are typically disposed on the bottom of the hull, and draw raw water from the water resource which will be used for the transfer of engine heat. A raw water return hose 72 returns the raw water, to which heat has been transferred, back to the water resource. The heat transfer cylinder, raw water inlet and pump and raw water return are all well known in the art.

A water pump inlet hose 74 attaches the water pump to the heat transfer cylinder 70, and feeds cold cooling fluid to the water pump. A water pump outlet hose 75 feeds the cold cooling fluid exiting the water pump to a fluid transfer manifold 76. Cold cooling fluid is transferred to the water jacket inlets of both cylinders 60 and 61 through hoses 77 and 78, respectively. Heated cooling fluid is returned to the fluid transfer manifold 76 through return lines 79 and 80. This heated cooling fluid is returned to the heat transfer cylinder 70 through hose 81.

The heat transfer cylinder may be disposed in the position as shown, or could be mounted away from the engine, if desired. The heat transfer cylinder would typically not be taller than the engine. The fluid transfer manifold would be disposed as shown on the top of the crank case, and would not extend above the top of the flywheel bell housing. It is understood that other mounting positions could be available for the heat transfer manifold which would not be at the top of the crank case. Although not shown, exhaust water jacket hoses which attach a water jacket disposed around each exhaust pipe to the fluid transfer manifold, could be used for each exhaust pipe. Alternatively, the exhaust pipes water jacket hoses could be attached directly to the heat transfer cylinder.

Figure 10:
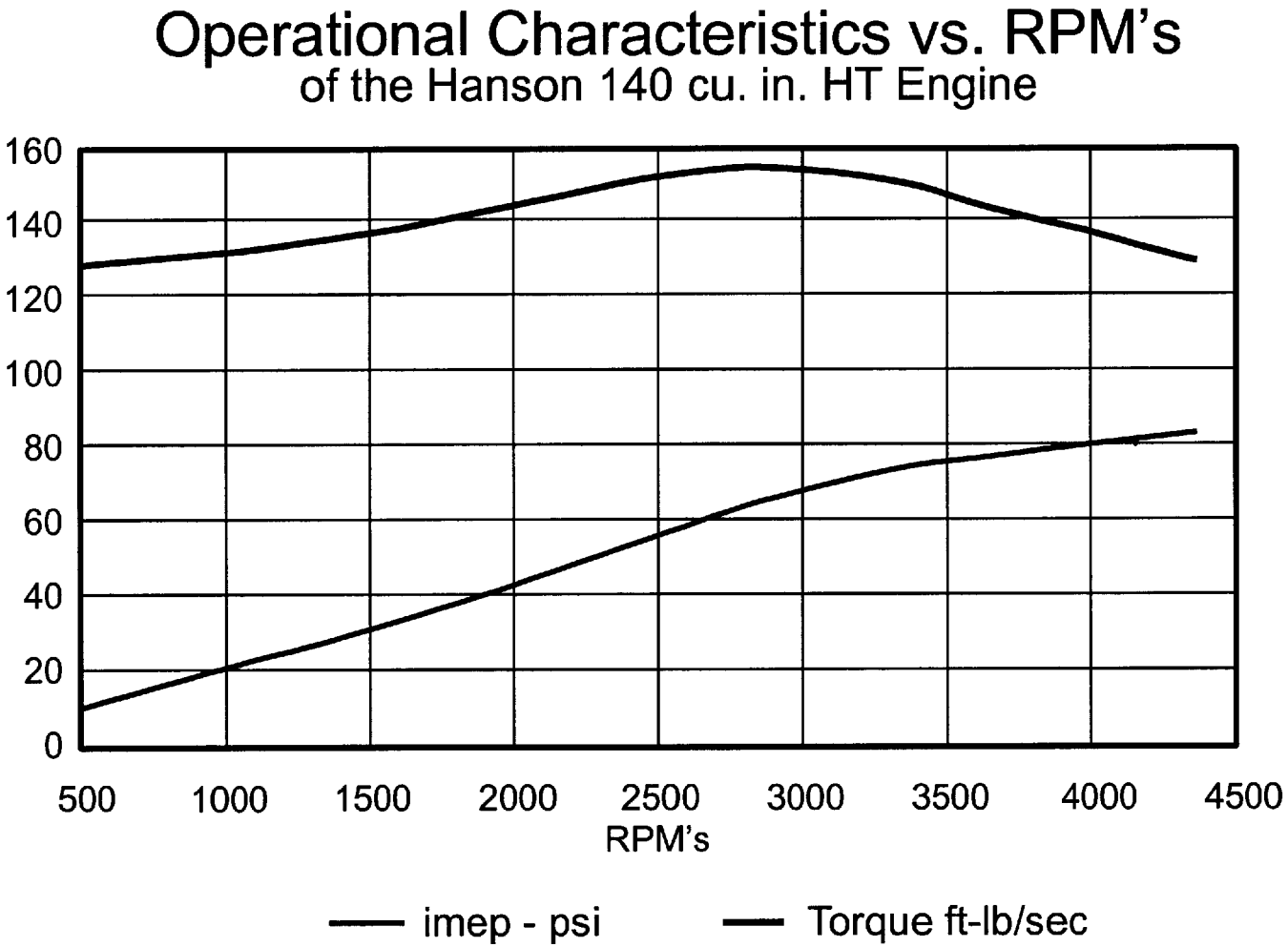
FIG. 10 is a graph of the operating characteristics of the engine.

FIG. 10 shows the operational characteristics of the engine and shows the high torques, which are above 120 ft—lb/sec, which are achieved at low RPM's.

Although a preferred version of the engine has been shown and described it is understood that various modifications to the engine are possible which remain within the spirit of the invention. Such modifications include the use of more than 2 cylinders, as a four cylinder, or possibly 6 or 8 cylinder engine could be built using the concepts taught by the invention. Also possible is the use of fuel injection in place of the carburetors. A engine block that included cylinders cast into the block as opposed to a crank case and attached cylinder jugs would be possible in the present invention. The large mass crank and large bore stroke relationship of the present invention could be used in a well know V block engine configuration. Two types of raw water cooling could be used in the invention. This would include: the described preferred version which is a closed system that uses cooling fluid cooled within a heat transfer mechanism through the use of raw water; or a second version using raw water entirely within the system and eliminating the heat transfer mechanism.

It is therefore understood that various other modifications and changes of form or detail could readily be made without departing from the spirit of the invention. It is intended that the invention be not limited to the exact form and detail herein shown and described, nor to anything less than the whole of the invention disclosed and hereinafter claimed.

I claim:

1. A horizontally opposed four cycle inboard gasoline marine engine for small water craft which comprises:

an engine block including an oil pan;

a crank shaft rotationally mounted in the engine block; wherein the crank shaft is for driving a marine propulsion system used along with the engine; and, wherein the crank shaft is horizontally disposed;

a flywheel connected to one end of the crank shaft; a timing belt and at least one cam shaft driven by the crank shaft through the timing belt;

at least one cylinder bore located on each end of the engine block; a piston which reciprocates in each cylinder bore connected to the crank shaft through a connecting rod; a cylinder head disposed on each cylinder bore; at least two valves disposed in each cylinder head; a valve cover mounted at each end of the engine on top of each cylinder head; an engine cooling system including engine coolant fluid; and wherein each cylinder bore is at least partially surrounded by a water jacket that receives engine coolant fluid from the engine cooling system; wherein the engine cooling system is designed for marine application and therefore operates in the absence of a radiator or a fan; and wherein the engine cooling system is adapted for co-operation with a heat transfer system that uses raw water from the water resource in which the water craft is used;

the engine further includes a gasoline fuel delivery system, an air induction system; and an ignition system;

wherein the engine includes a front and a rear, and a top and a bottom; and wherein the overall height of the engine as measured from the top to the bottom between the front and rear of the engine is less than 5 times the bore diameter of the cylinder bores; wherein the engine is adapted for placement in an engine compartment in a small water craft of a type which includes a hull, a transom at the back of the hull, and a deck disposed above the hull;

wherein the engine includes means for attachment of a marine propulsion system and wherein the engine is adapted for powering a marine propulsion system.

2. The gasoline marine engine of claim 1, wherein the means for attachment of a marine propulsion system is the flywheel.

3. The gasoline marine engine of claim 1, further including a main drive belt and a flywheel bell housing, and wherein the front of the engine is the main drive belt, and wherein the back of the engine is the bell housing.

4. The gasoline marine engine of claim 3, wherein the valve covers include a distal end, and wherein the engine includes a length defined by the distance between the distal ends of the two valve covers, and wherein the height of the engine as defined by the distance from the bottom of the oil pan to the highest engine component is less than half of the length.

5. The gasoline marine engine of claim 1, wherein the engine block includes a crank case and a cylinder jug located on each end of the crank case; wherein each cylinder bore is disposed in a cylinder jug.

6. A horizontally opposed four cycle inboard gasoline marine engine for small water craft which comprises:

an engine block including an oil pan;

a crank shift rotational mounted in the engine block; wherein the crank shaft is for driving a marine propulsion system used along with the engine; and, wherein the crank shaft is horizontally disposed;

a flywheel connected to one end of the crank shaft; a timing belt and at least one cam shaft driven by the crank shaft through the timing belt;

at least one cylinder bore located on each end of the engine block; a piston which reciprocates in each center bore connected to the crank shaft through a connecting rod; a cylinder head disposed on each cylinder bore; at least two valves disposed in each cylinder head; a valve cover mounted at each end of the engine on top of each cylinder head; an engine cooling system including engine coolant fluid; and wherein cylinder bore is at least partially surrounded by a water jacket that receives engine coolant fluid from the engine cooling system; wherein the engine cooling system is designed for marine application and therefore operates in the absence of a radiator or a fan; and wherein the engine cooling system is adapted for co-operation with a heat transfer system that uses raw water from the water resource in which the water craft is used;

the engine further includes a gasoline fuel delivery, an air induction system; and an ignition system;

wherein the engine includes a front and a roar, and a top and a bottom; and wherein the overall height of the engine as measured from the top to the bottom between the front and rear of the engine is less than twice the length of the connecting rods as measured from the centers of the attachment points on the crank shaft and piston; wherein the engine is adapted for placement in an engine compartment in a small water craft of a type which includes a hull, a transom at the back of the hull, and a deck disposed above the hull;

wherein the engine includes means for attachment of a marine propulsion system and wherein the engine is adapted for powering a marine propulsion system.

7. The gasoline marine engine of claim 6, wherein the means for attachment of a marine propulsion system is the flywheel.

8. The gasoline marine engine of claim 6, further including a main drive belt and a flywheel bell housing, and wherein the front of the engine is the main drive belt, and wherein the back of the engine is the bell housing; and wherein the top of the flywheel bell housing defines the top of the engine; and wherein the bottom of the oil pan defines the bottom of the engine.

9. The gasoline marine engine of claim 6, wherein the valve covers include a distal end, and wherein the engine includes a length defined by the distance between the distal ends of the two valve covers, and wherein the height of the engine as defined by the distance from the bottom of the oil pan to the highest engine component is less than half of the length.

10. The gasoline marine engine of claim 6, wherein the engine block includes a crank case and a cylinder jug located on each end of the crank case; wherein each cylinder bore is disposed in a cylinder jug.

* * * * *